United States Patent [19]

Dholakia

[11] 4,243,395

[45] Jan. 6, 1981

[54] METHOD FOR PRECISION GRINDING OF HARD, POINTED MATERIALS

[75] Inventor: Anil R. Dholakia, East Windsor, N.J.

[73] Assignee: RCA Corporation, New York, N.Y.

[21] Appl. No.: 48,166

[22] Filed: Jun. 13, 1979

[51] Int. Cl.[3] ..... B24D 3/34

[52] U.S. Cl. ..... 51/293; 51/281 R

[58] Field of Search ..... 51/281 R, 293

[56] References Cited

U.S. PATENT DOCUMENTS

| | | | |
|---|---|---|---|
| 2,899,288 | 8/1959 | Barclay | 51/295 |
| 4,104,832 | 8/1978 | Keizer | 51/281 |

*Primary Examiner*—Donald J. Arnold
*Assistant Examiner*—W. Thompson
*Attorney, Agent, or Firm*—Birgit E. Morris; Allen Bloom

[57] ABSTRACT

A method of lapping the sharp point of a hard material using a silicon oxide, glow discharge deposited abrasive layer wherein the abrasive layer is thick enough to prevent penetration of the point into the substrate.

7 Claims, 3 Drawing Figures

METHOD FOR PRECISION GRINDING OF HARD, POINTED MATERIALS

This invention relates to a method for lapping the tip of a hard, pointed material. More particularly, this method relates to lapping a hard, sharp-tipped material with an abrasive-coated substrate.

BACKGROUND OF THE INVENTION

It has been previously found that continuous, amorphous layers comprising silicon oxide coatings about 200 to about 300 angstroms thick which were prepared by the glow discharge deposition of silane or its derivatives on a substrate can be employed to lap hard materials such as sapphire and diamond. However, a problem was uncovered during the lapping process when the object was to flatten a tip having a sharp point, e.g., a radius of from about 0.1 to about 0.01 micrometers or less. It was found that these sharp points broke off, leaving a jagged end instead of the desired flat surface when a hard substrate was employed beneath the lapping material. If a soft substrate was used, after lapping the tip was either longer and narrower than desired or broke off in an irregular manner.

SUMMARY OF THE INVENTION

I have found that the continuous, abrasive layer comprising a silicon oxide prepared by the glow discharge of silane or its derivatives on a substrate can be used to lap the point of a hard material having a sharp point to form a flat end with reduced breakage of the material and a smooth finish on the lapped surface without destroying the lapping medium when the abrasive layer is thick enough so that the point cannot penetrate through the abrasive layer to the substrate. The method can be used where the hard material is diamond, sapphire and the like.

DETAILED DESCRIPTION OF THE INVENTION

Abrasive coatings of a silicon oxide such as $SiO_x$ or $SiO_2$ can be prepared by deposition upon a substrate employing the glow discharge technique and the appropriate precursors, as is known $SiO_x$ may be considered to comprise a mixture of $SiO_2$ and SiO. One method to deposit an abrasive silicon oxide layer utilizes a glow discharge of oxygen and a silicon alkoxide precursor having the formula

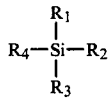

wherein $R_1$ is selected from the group consisting of H and $CH_3$, $R_2$ and $R_3$ are independently selected from the group consisting of H, $CH_3$, $OCH_3$ and $OC_2H_5$ and $R_4$ is selected from the group consisting of $OCH_3$ and $OC_2H_5$. An example of such a silicon alkoxide precursor is methyldimethoxysilane, $SiH(CH_3)(OCH_3)_2$. Relative partial pressure ratios of oxygen to methyldimethoxysilane of from about 1.5:1 to about 4:1 were found to give suitably abrasive layers rich in $SiO_2$.

Another more abrasive silicon oxide layer having the formula $SiO_x$ can be prepared when the precursors are $SiH_4$ and a gaseous oxygen source, such as $N_2O$, $CO_2$, $H_2O$, $O_2$ and the like. The value of x depends upon the ratio of $SiH_4$ to the oxygen source. When the $SiO_2$ to SiO ratio, as measured by infrared spectroscopy, is greater than about 1, preferably greater than 1.5, and most preferably about 2.5, the coating becomes extremely abrasive.

In order to obtain an $SiO_x$ coating with a desired $SiO_2$ to SiO ratio, the partial pressure ratio between $SiH_4$ and $N_2O$ or $H_2O$ during the deposition should be about 1:1 to about 1:8, preferably about 1:3 to about 1:8 and most preferably about 1:4. For $SiH_4$ and $CO_2$ the partial pressure ratio should be from about 2:1 to about 1:4, preferably about 1:1.5.

Figure 1:
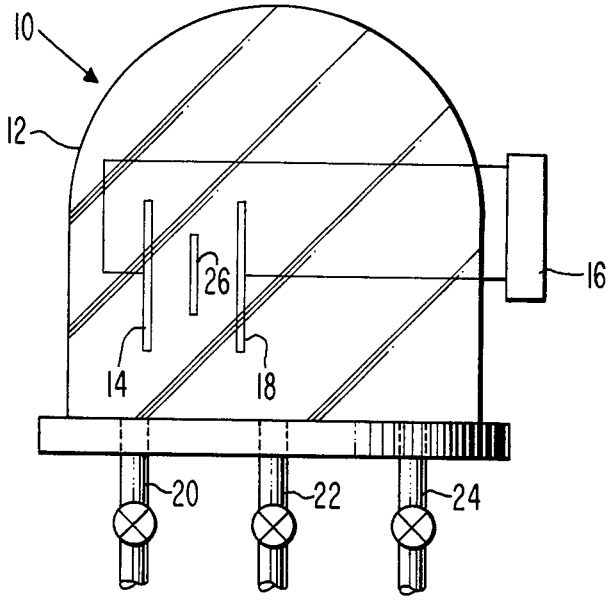
FIG. 1 is a schematic diagram of an apparatus for preparing abrasive coatings suitable for use in the invention.

A suitable glow discharge apparatus 10 for depositing an abrasive layer is shown in FIG. 1. The glow discharge apparatus 10 includes a vacuum chamber 12 such as a glass bell jar. In the vacuum chamber are two electrodes 14 and 18 which can be a screen, coil or plate of a material that is a good electrical conductor such as platinum or graphite. The electrodes 14 and 18 are connected to an external power source 16 which may be DC or AC. Thus there will be a voltage potential between the electrodes 14 and 18. When low pressures and current frequencies other than radio frequencies are used, the plasma is enhanced by means of magnets (not shown) on the electrodes 14 and 18.

An outlet 20 from the vacuum chamber 12 allows for evacuation of the system and is connected to a mechanical-diffusion pump system. First and second inlets 22 and 24, respectively, are connected to gas bleed systems for adding gases as needed in the coating process. In carrying out the coating process the substrate 26 to be coated is placed between the electrodes 14 and 18, typically maintained about 5–10 cm apart. The vacuum chamber 12 is then evacuated to about $0.5\text{–}1\times10^{-6}$ millimeters of mercury through the outlet 20. An inert gas such as argon or an oxygen source such as oxygen itself or $N_2O$ may be added through the first inlet 22. The silicon precursor is added through the second inlet 24.

A glow discharge is initiated between the electrodes 14 and 18 by energizing the power source 16, whereupon deposition of the abrasive layer on the substrate 26 begins. For deposition, a suitable current density is in the range of 1–5 milliamps per square centimeter at a frequency of 10 kilohertz. The potential between electrodes 14 and 18 is about 500 to 1000 volts. Under these conditions when the precursors are methyldimethoxysilane and oxygen, the abrasive layer will be deposited at the rate of about 40–80 angstroms per minute. When the starting materials are silane and $N_2O$, the deposition rate is about 50–500 angstroms per minute.

When a thermally sensitive substrate such as vinyl is employed, care must be taken to prevent excessive heating of the substrate. Therefore, for vinyl, to prevent the temperature from exceeding about 50° C., the power supply 16 is periodically turned off. When $SiH_4$ and $N_2O$ are the starting materials, the glow discharge is stopped after about 75–90 seconds, at which time a layer about 200 to 300 angstroms thick has been deposited. When methyldimethoxysilane is the precursor, the substrate reaches 50° C. after about 3–5 minutes at which time an $SiO_2$ layer about 200 to 300 angstroms thick has been deposited. The substrate is then allowed to cool for about 5 minutes under vacuum at which time the substrate temperature is about 25° C. The above procedure is repeated until the desired coating thickness is obtained.

Inhomogeneity of the abrasive layer caused by the interruption in the glow discharge deposition is observed when a silicon alkoxide precursor and oxygen are employed as the starting materials. Therefore, after the vinyl substrate is allowed to cool to about 25° C. under vacuum which requires about 5 minutes, a glow discharge in an oxygen atmosphere is used before resuming depositions with both starting materials. The above procedure is repeated until the desired coating thickness is obtained. This procedure is described in the copending application of Wang et al, Ser. No. 048,161, filed June 13, 1979, entitled "Method of Depositing an Abrasive Layer," which is being filed concurrently and is incorporated by reference.

The thickness of the abrasive coating needed to prevent penetration of the hard, sharp-pointed material into the substrate depends on the sharpness of the point, the density of the abrasive layer, the hardness of the material, and the force applied in contacting the abrasive layer and the point during lapping. For a diamond tip having a radius of about 0.1 to about 0.01 micrometer or less and an applied force of about 10 milligrams, a suitable minimum thickness of a silicon oxide abrasive layer is about 2000 angstroms.

If the thickness of the silicon oxide is not sufficient to prevent the point from penetrating into the substrate then the point will not be lapped properly. When a hard substrate such as glass or cast iron is used, the imbedded tip breaks off, leaving a jagged end instead of the desired flat surface. Furthermore, if the amount of material to be removed is small, on the order of a few cubic micrometers, a much greater amount of material than is desired to be removed may break off. Alternatively, a softer substrate, such as plastic or rubber may be used in conjunction with the amorphous silicon oxide abrasive layer. Again, the tip becomes imbedded in the substrate. Since the hard material is stronger than the substrate it plows through the substrate while the part of the material above the imbedded point in contact with the silicon oxide abrasive layer is abraded. Thus, when a soft substrate is used, after lapping the tip is either longer and narrower than desired or breaks off in an irregular manner. Again, if the amount of material to be removed is small, more than the desired amount may break off.

One application of the instant invention is in the shaping of diamond styli for use with capacitive video discs. A method for producing suitable styli was described in U.S. Pat. No. 4,104,832 of Keizer. A front view of a pyramidal-shaped diamond 100 is shown in a front view in FIG. 2. The front face 108 is defined by edges 102 and 104, and along with edge 106, define the other two faces. The front face 108, which acts as an electrode, is coated with a thin layer of a conductive material, for example, an about 0.15 to about 0.2 micrometer thick layer of a metal such as tantalum, titanium, hafnium and the like. The apex of the pyramid 110 has a radius of about 0.1 to about 0.01 micrometer or less. The angle made by the intersection of edges 102 and 104 at 110 is about 55°–65°. A preliminary step in the preparation of video disc styli using the method of Keizer is the flattening or shoe lapping of the point 110.

Figure 3:
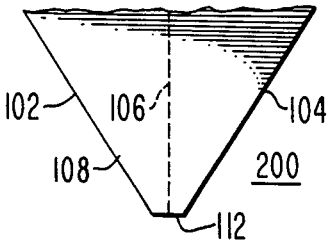
FIG. 3 is a front view of a lapped metal coated diamond.
Figure 4:
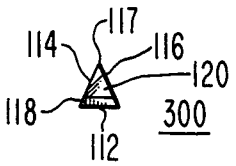

Following shoe lapping on a grooveless substrate coated with an abrasive layer of the appropriate thickness as described herein, the apex 110 has been lapped to a flattened shoe with its edge 112 on diamond 200 as shown as a front view in FIG. 3. A bottom view of the diamond 200 is the footprint 300 shown in FIG. 4. The edges defining the footprint are 112, 114 and 116. The front face 108 of the stylus 200 is coated with a thin layer 118 of a conductive material. The apex 117 of the triangular footprint 300 is shown as is the shoe surface 120.

The degree of relative motion between the abrasive layer and the hard, sharp-pointed material influences the finish of the lapped article as well as the speed with which material is removed. For a 2000 angstrom thick silicon oxide layer using a force of 10 milligrams between a sharp diamond point and the abrasive layer, a relative motion of from about 50 to about 450 revolutions per minute (rpm) were found to be effective. At 50 rpm about 0.025 to about 0.05 cubic micrometers per minute of material was removed with a feature size on the lapped diamond surface of less than about 100 angstroms. More material was removed at the higher rates, about 0.1 cubic micrometer per minute at 450 rpm. Although no substantial difference in feature size occurred at the different lapping speeds employed, more chipping at the edges and corners resulted at the higher speeds.

The nature of the substrate also influences the lapping of the point. A hard substrate material, such as glass which cannot absorb mechanical vibrations and shock, results in the stylus vibrating during lapping. These vibrations lead to an uneven finish of the lapped surface and breakage of the tip. A soft substrate material, for example, rubber or a plastic such as vinyl, is able to damp the vibrations and shock which occur during lapping. Use of a damping substrate material results in a smoother surface on the lapped article with reduced incidence of tip breakage. A vinyl substrate coated with a thin layer of a metal may also be used. For example, 200 angstroms of an alloy of nickel, chromium and iron deposited on a vinyl substrate by vacuum sputtering using an Inconel 600 target. Inconel 600 comprises about 76 weight percent Ni, about 16 weight percent Cr and about 8 weight percent Fe, and is available from the International Nickel Co.

The invention will be further illustrated by the following Examples but it is to be understood that the invention is not meant to be limited to the details described therein.

EXAMPLE 1

A flat, grooveless vinyl disc substrate 26 having a diameter of 30.5 cm and a thickness of 0.18 cm was placed in the glow discharge deposition apparatus 10 shown in FIG. 1. Electrodes 14 and 18 were 8 cm apart and the substrate 26 was placed between them. The vacuum chamber 12 was evacuated through outlet 20 to a pressure of $5\times10^{-7}$ millimeters of mercury. Oxygen was admitted through first inlet 22 so that its partial pressure in the vacuum chamber 12 was 25 micrometers of mercury. The system was allowed to stabilize for two minutes. Methyldimethoxysilane was admitted through second inlet 24 so that its partial pressure in the vacuum chamber 12 was 11 micrometers of mercury. The system was allowed to stabilize for one minute.

A glow discharge was initiated by activating the power supply 16. The frequency was 10 kilohertz and the power density was 1 watt/cm$^2$. The glow discharge was continued for four minutes. The supply of methyldimethoxysilane through second inlet 24 was stopped, the power supply 16 was turned off and the oxygen supply through inlet 22 was shut off. If the desired final thickness of $SiO_x$ had not yet been obtained, the system was evacuated through outlet 20 and after five minutes the pressure in the vacuum chamber 12 was $5\times10^{-6}$ millimeters of mercury. Oxygen was then readmitted through first inlet 22 to a partial pressure of 25 micrometers of mercury, and the system was allowed to stabilize for about two minutes. The power supply 16 was turned on. It operated at a frequency of 10 kilohertz and provided a power density of 1 watt/cm$^2$. The resulting glow discharge supported by oxygen was allowed to continue for 20 seconds after which the power supply 16 was turned off.

The above process was repeated until a layer about 2100 angstroms thick was deposited. Seven glow discharge depositions of methyldimethoxysilane and oxygen were required. The layer was found to be rich in $SiO_2$ by infrared analysis. The layer appeared to be continuous, amorphous and homogeneous. The layer exhibited good adhesion and hardness when subjected to scratch tests using a conventional microhardness tester. X-ray fluorescence measurements on four separated parts of the disc indicated good uniformity of composition and thickness with standard deviations of less than 10 percent for Si.

The thickness of the sample was estimated based on the measured rate of deposition on Si wafers as determined by ellipsometry.

A pyramidal shaped diamond 100 having a tip 110 less than 0.1 micrometer in diameter and having a 1500 angstrom thick coating of tantalum on a front face 108 was flattened (shoe lapped) by contacting the diamond tip 110 and the glow-discharge-deposited layer with a force (tracking force) of 10 milligrams. After 10 minutes with the disc rotating at 50 rpm, 0.5 cubic micrometer of material was removed leaving a diamond 200 as shown in FIG. 3. The edge of the lapped shoe 112 was 2 micrometers long. The minimum feature size on the shoe surface 120 was less than 100 angstroms.

EXAMPLE 2

The conditions of Example 1 were used except that the disc was rotated at 450 rpm. After 5 minutes 0.5 cubic micrometer was removed.

EXAMPLE 3

A 30.5 cm diameter grooveless vinyl disc substrate 26 0.18 cm thick was placed in a 46 cm$\times$76 cm bell jar vacuum chamber 12 as described in FIG. 1 which was then evacuated to $10^{-6}$ torr. $N_2O$ was added to a partial pressure of 32 microns of Hg through first inlet 22 using a flow of 35 standard cubic centimeters per minute (sccm). $SiH_4$ was then added through second inlet 24 to a total pressure of 40 microns of Hg. The partial pressure ratio of $SiH_4$ to $N_2O$ was 1:4.

The disc substrate 26 was rotated at a rate of 30 rpm between two 15 cm$\times$15 cm metal electrodes 14 and 18. These electrodes 14 and 18 covered a strip approximately 6 cm wide on the disc. To create a glow between the electrodes 14 and 18, current was supplied to the electrodes 14 and 18 at a rate of 500 milliamps with a potential of about 1000 volts at 10 KHz from power supply 16. The resulting deposition of an abrasive coating onto the disc 26 was continued for 75 seconds. A coating about 250 angstroms thick had been deposited. The glow discharge power supply 16 and first and second inlets 22 and 24, respectively were then shut off for 5 minutes to allow the substrate to cool while the system was allowed to evacuate through outlet 20. The deposition procedure was repeated until a 2000 angstrom thick coating of $SiO_x$ was prepared.

Figure 2:
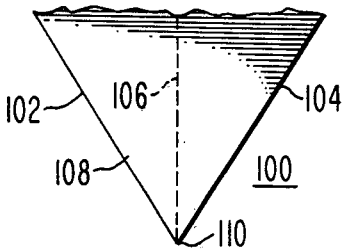
FIG. 2 is a front view of a metal coated diamond point.

Pyramidal-shaped diamond styli 100 having a tip 110 less than 0.1 micrometer in diameter, as shown in FIG. 2 and described in Example 1, were shoe lapped to form styli 200 as in FIG. 3 by rotating the disc 26 at 72 rpm with a tracking force of 10 milligrams. Two to ten seconds were required to shoe lap the styli so that edge 112 was about 1.6 micrometers long. The minimum feature size on the shoe surface 120 was less than 100 angstroms.

I claim:

1. In a method of lapping the tip of a hard material having a sharp point to provide a flattened tip of a predetermined length comprising the steps of rotating a substrate having an abrasive layer of amorphous $SiO_x$ thereon, said abrasive layer formed by a glow discharge of a silicon compound, and contacting the abrasive layer and the tip, the improvement which comprises using an abrasive layer that is thick enough such that the tip can not penetrate through the abrasive layer to the underlying substrate.

2. The method of claim 1 wherein the substrate is vinyl.

3. The method of claim 1 wherein the substrate is metal-coated vinyl.

4. The method of claim 1 wherein the thickness of the abrasive layer is at least about 2000 angstroms.

5. The method of claim 1 wherein the hard material is diamond.

6. The method of claim 1 wherein the hard material is sapphire.

7. The method of claim 1 wherein the point is less than about 0.1 micrometer in diameter.

* * * * *